US011685040B1

(12) United States Patent
Arifi et al.

(10) Patent No.: US 11,685,040 B1
(45) **Date of Patent: *Jun. 27, 2023**

(54) ADJUSTABLE SCRIBE AND ASSOCIATED USE THEREFORE

(71) Applicants: Bedri Arifi, Stamford, CT (US); James Walsh, Westport, CT (US)

(72) Inventors: Bedri Arifi, Stamford, CT (US); James Walsh, Westport, CT (US)

( * ) Notice: Subject to any disclaimer, the term of this patent is extended or adjusted under 35 U.S.C. 154(b) by 56 days.

This patent is subject to a terminal disclaimer.

(21) Appl. No.: 17/400,505

(22) Filed: Aug. 12, 2021

Related U.S. Application Data

(63) Continuation of application No. 16/181,096, filed on Nov. 5, 2018, now Pat. No. 11,117,251.

(60) Provisional application No. 62/581,450, filed on Nov. 3, 2017.

(51) Int. Cl.
*B25H 7/04* (2006.01)
*E04F 21/00* (2006.01)

(52) U.S. Cl.
CPC ..... *B25H 7/045* (2013.01); *E04F 21/003* (2013.01)

(58) Field of Classification Search
USPC ..... 33/32.2, 194
See application file for complete search history.

(56) References Cited

U.S. PATENT DOCUMENTS 2,473,639 A * 6/1949 Erickson ..... E04F 21/003 33/562
3,278,177 A * 10/1966 Zern ..... B23B 47/287 267/41
5,737,844 A * 4/1998 Brumley ..... B25H 7/00 33/194
5,775,036 A * 7/1998 Stanley, Sr. ..... E04F 21/0015 52/749.1
6,305,091 B1 * 10/2001 Tegels ..... E04F 21/003 269/95
6,513,258 B1 * 2/2003 Casner ..... E04F 21/0069 33/526
6,941,605 B2 * 9/2005 McCreesh ..... B43L 13/02 7/164
7,069,659 B1 * 7/2006 Rye ..... E04F 21/003 33/562
7,240,435 B1 * 7/2007 Dowdakin ..... E04F 21/0015 33/194
7,509,746 B1 * 3/2009 Kozina ..... A47G 27/0487 33/194
7,644,502 B2 * 1/2010 Arne ..... E04F 21/00 33/194

(Continued)

*Primary Examiner* — Christopher W Fulton
(74) *Attorney, Agent, or Firm* — Ashkan Najafi

(57) ABSTRACT

An adjustable carpentry reveal tool includes a base member, and a sliding member slidably engaged to the base member wherein the sliding member is configured to be selectively displaced along predetermined linear increments relative to the base member without becoming detached from the base member. Advantageously, the sliding member is configured to simultaneously mark a pair of adjustable reveals along the x-axis and the y-axis of the trim corner of the frame opening without having to fasten the base member to the trim corner of the frame opening. Notably, in this manner, the adjustable reveals are defined between an outermost periphery of the base member and an outermost periphery of the sliding member.

19 Claims, 6 Drawing Sheets

(56) References Cited

U.S. PATENT DOCUMENTS

| | | | | |
|---|---|---|---|---|
| 7,743,517 | B1 * | 6/2010 | Burgese | E04F 21/0069 33/194 |
| 7,849,607 | B2 * | 12/2010 | Alvarez | E04F 21/003 33/194 |
| 8,096,056 | B1 * | 1/2012 | Murdock | G01B 3/566 33/526 |
| 11,117,251 | B1 * | 9/2021 | Arifi | E04F 21/003 |
| 2003/0131486 | A1 * | 7/2003 | Wallace | B25H 7/00 33/194 |

* cited by examiner

ADJUSTABLE SCRIBE AND ASSOCIATED USE THEREFORE

CROSS REFERENCE TO RELATED APPLICATIONS

This is a U.S. continuation non-provisional patent application that claims the benefit of and priority to U.S. non-provisional patent application Ser. No. 16/181,096, filed on Nov. 5, 2018, now U.S. Pat. No. 11,117,251, which claims the benefit of and priority to U.S. provisional patent application No. 62/581,450, filed on Nov. 3, 2017, now abandoned, both aforementioned applications are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to carpentry tools for installing trim work and, more particularly, to an adjustable carpentry reveal tool (scribe) for simultaneously marking reveals along two orthogonal axes at a trim corner of a door or window opening, without having to affix the tool to the trim corner.

Prior Art

Building construction involves precise measurements and calculations in order for a structure to be properly built. One mistake or miscalculation can be magnified many times over and can result in the redoing and recalculation of substandard work. In particular, in the field of carpentry, it is frequent practice in the construction of thresholds for doors, windows and the like to install trim work to serve an ornamental function by hiding what would otherwise be roughed in structural framing of the window, door or the like. In doing so, a carpenter must have the capacity to measure and set a consistent reveal around the perimeter of the roughed in structural framework, the consistent reveal to serve as the guide for the placement of decorative trim or molding to "finish" the threshold in relation to adjacent sheetrock and/or drywall.

The construction of such thresholds, consistency in the measurement of the reveals ultimately determines whether the appearance of the trim, molding and "finished" thresholds are going to appear consistent throughout the construction project and, thus, whether the integrity of the carpentry throughout the project will meet customer expectations.

Despite the practice of setting reveals according to known measurements, commonly ¼", ½" or ¾", differing carpenters may and frequently do differ in their respective calculations of these known measurements. Be it difference in measuring convention or just pure human error, the result of varying carpenters working on a single construction product with inconsistent methods of measuring what should be a singular and constant, fixed reveal is inconsistencies in appearance as between thresholds and, thus, poor aesthetic craftsmanship in the overall project.

The field of carpentry is no stranger to the use of varying guides, gauges and tools to ensure consistency in measurement. However, with regard to setting reveals in the construction of thresholds, it has become desirable to provide a tool that is (i) easily portable, (ii) of small enough size to allow a single carpenter to manipulate the tool while simultaneously marking a measured reveal, (iii) manufactured in a such a way as to mitigate the likelihood and opportunity of inconsistent measurements due to human error or divergent measuring conventions, and (iv) capable of simultaneous use in two orthogonal directions for the accurate measurement of reveals in the corner of a given threshold. It has further become desirable to provide a tool that serves all of the aforementioned purposes while minimizing the number of components comprising the tool, thus, enhancing the efficiency and affordability of manufacture of the same.

Accordingly, a need remains for an adjustable carpentry reveal tool (scribe) in order to overcome at least one of the above-noted shortcomings. The exemplary embodiment(s) satisfy such a need by an adjustable carpentry reveal tool (scribe) that is convenient and easy to use, lightweight yet durable in design, versatile in its applications, and designed for simultaneously marking reveals along two orthogonal axes at a trim corner of a door or window opening, without having to affix the tool to the trim corner.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an adjustable carpentry reveal tool (scribe) for simultaneously marking two reveals along an x-axis and a y-axis at a trim corner of a frame opening. These and other objects, features, and advantages of the non-limiting exemplary embodiment(s) are provided by an adjustable carpentry reveal tool (scribe) including a base member, and a sliding member slidably engaged to the base member wherein the sliding member is configured to be selectively displaced along predetermined linear increments relative to the base member without becoming detached from the base member. Advantageously, the sliding member is configured to simultaneously mark a pair of adjustable reveals along the x-axis and the y-axis of the trim corner of the frame opening without having to fasten the base member to the trim corner of the frame opening. Notably, in this manner, the adjustable reveals are defined between an outermost periphery of the base member and an outermost periphery of the sliding member.

In a non-limiting exemplary embodiment, the sliding member includes a pair of contiguous rectilinear edges, and the base member includes a corresponding pair of contiguous rectilinear edges. Advantageously, the contiguous rectilinear edges of the sliding member are linearly and equidistantly spaced from the contiguous rectilinear edges of the base member when the sliding member is linearly displaced relative to the base member. Notably, in this manner, the adjustable reveals are defined by a lateral distance between the contiguous rectilinear edges of the sliding member and the contiguous rectilinear edges of the base member.

In a non-limiting exemplary embodiment, the contiguous rectilinear edges of the base member are configured to be slidably and directly abutted against the trim corner of the frame opening such that the contiguous rectilinear edges of the sliding member extend beyond the trim corner of the frame opening.

In a non-limiting exemplary embodiment, the base member has a substantially square shape including a first open front corner and a first closed rear corner opposed therefrom. The base member further includes a first longitudinal axis centrally registered from the first open front corner to the first closed rear corner. The sliding member has a substantially square shape including a second open front corner and a second closed rear corner opposed therefrom, and a second longitudinal axis centrally registered from the second open front corner to the second closed rear corner.

In a non-limiting exemplary embodiment, the sliding member includes a ratchet configured to be resiliently articulated relative to the base member. Notably, the base member includes a bottom side including a slot having a slotted track provided with a plurality of serrated sides configured to selectively receive the ratchet along a predetermined linear path. Such serrated sides includes a plurality of notches. Notably, each of the first longitudinal axis and the second longitudinal axis are oriented parallel to the predetermined linear path.

In a non-limiting exemplary embodiment, the serrated notches are equidistantly spaced apart at opposite sides of the first centrally registered longitudinal axis. Advantageously, the base member further includes a top side having a plurality of rectilinear grooves disposed therealong. Such grooves are extended parallel to the first centrally registered longitudinal axis and the linear increments of the sliding member. Surface indicia including a plurality of predefined measurements is printed on the top side of the base member thereby identifying the reveal. Advantageously, the sliding member includes a plurality of rectilinear tongues oppositely spaced apart and registered parallel to each other, such that the tongues are slidably reciprocated within the grooves when the sliding member is reciprocated relative to the base member.

In a non-limiting exemplary embodiment, the ratchet is disposed at the second open front corner and includes a pair of oppositely facing fingers extended outwardly and way from the second centrally registered longitudinal axis. Advantageously, such fingers are selectively interlocked with the serrated sides at the bottom side of the base member.

In a non-limiting exemplary embodiment, the ratchet is configured to be depressed downwardly towards the base member such that the fingers are displaced out from an initial pair of the notches and the sliding member is linearly displaced a desired distance along the grooves. Advantageously, the sliding member is configured to be prohibited from being displaced relative to the base member when the fingers are interlocked with a desired pair of the notches.

In a non-limiting exemplary embodiment, each of the first longitudinal axis and the second longitudinal axis are offset 45 degrees relative to each of the x-axis and the y-axis. In this manner, each of the first longitudinal axis and the second longitudinal axis are offset 45 degrees relative to the adjustable reveals.

The present disclosure further includes a method of utilizing a carpentry reveal tool for simultaneously marking two reveals along an x-axis and a y-axis at a trim corner of a frame opening. Such a method includes the steps of: providing a base member; providing and slidably engaging a sliding member to the base member; positioning the base member against the trim corner of the frame opening; selectively displacing the sliding member along predetermined linear increments relative to the base member without detaching the sliding member from the base member; and the sliding member simultaneously marking a pair of adjustable reveals along the x-axis and the y-axis of the trim corner of the frame opening without having to fasten the base member to the trim corner of the frame opening. Advantageously, the adjustable reveals are defined between an outermost periphery of the base member and an outermost periphery of the sliding member.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
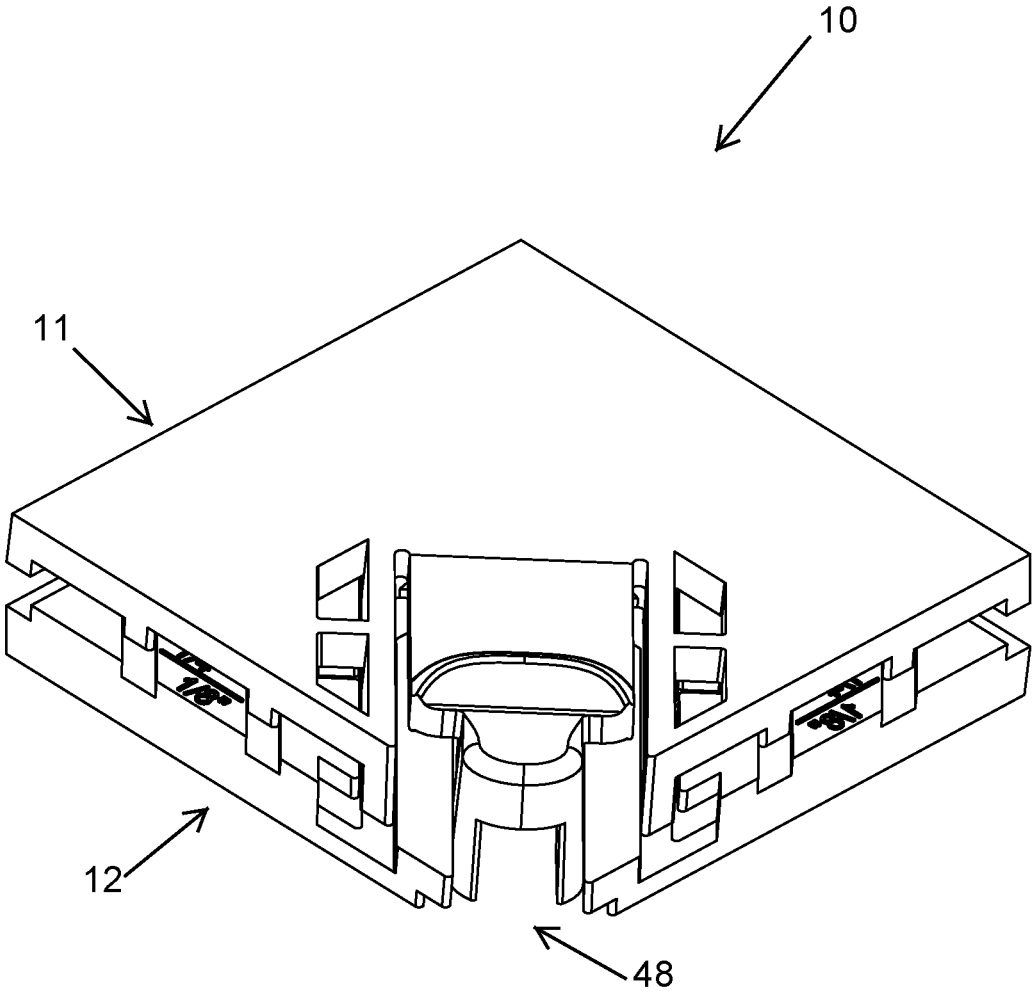
FIG. 1 is an adjustable carpentry reveal tool (scribe), in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

The terms "carpentry reveal tool" and "scribe" are interchangeably used throughout this disclosure.

Figure 2:
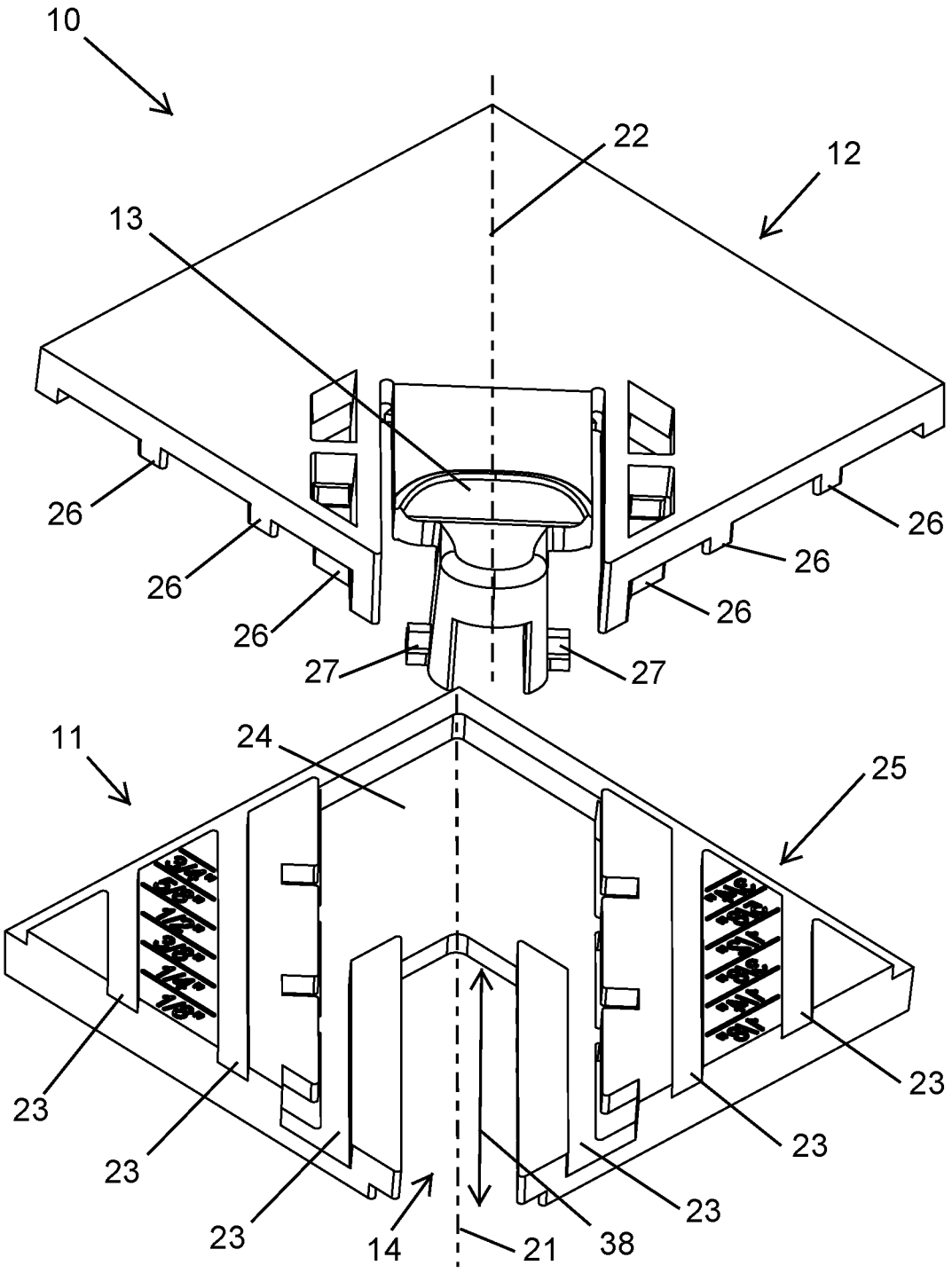
FIG. 2 is an exploded view of the adjustable carpentry reveal tool (scribe) shown in FIG. 1.
Figure 3:
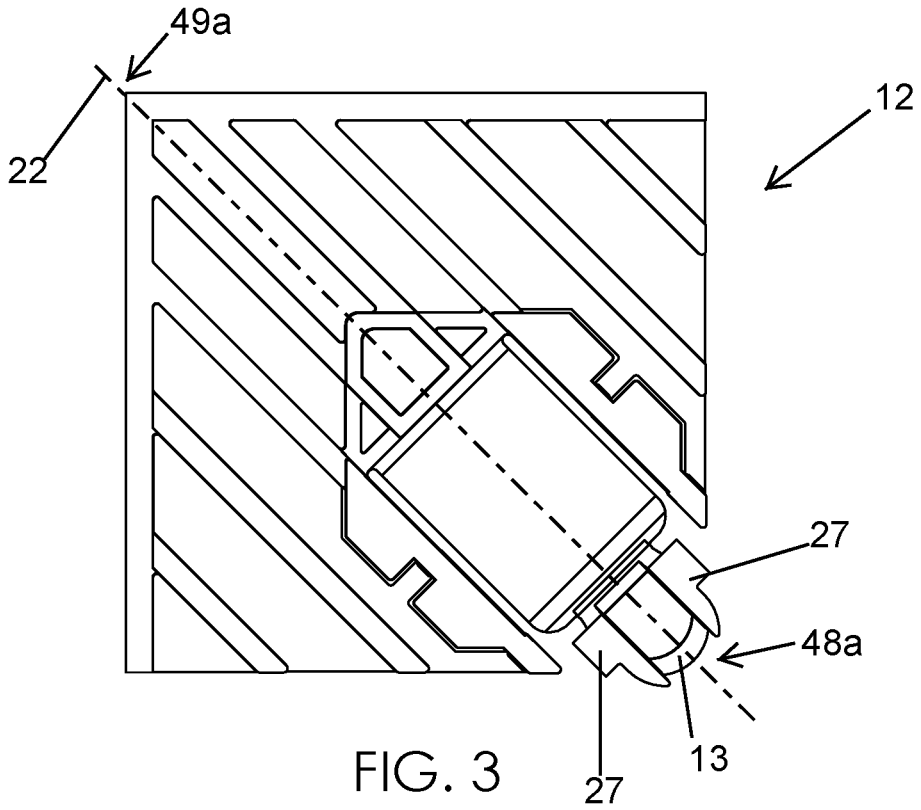
FIG. 3 is bottom plan view of the sliding member shown in FIG. 1.
Figure 4:
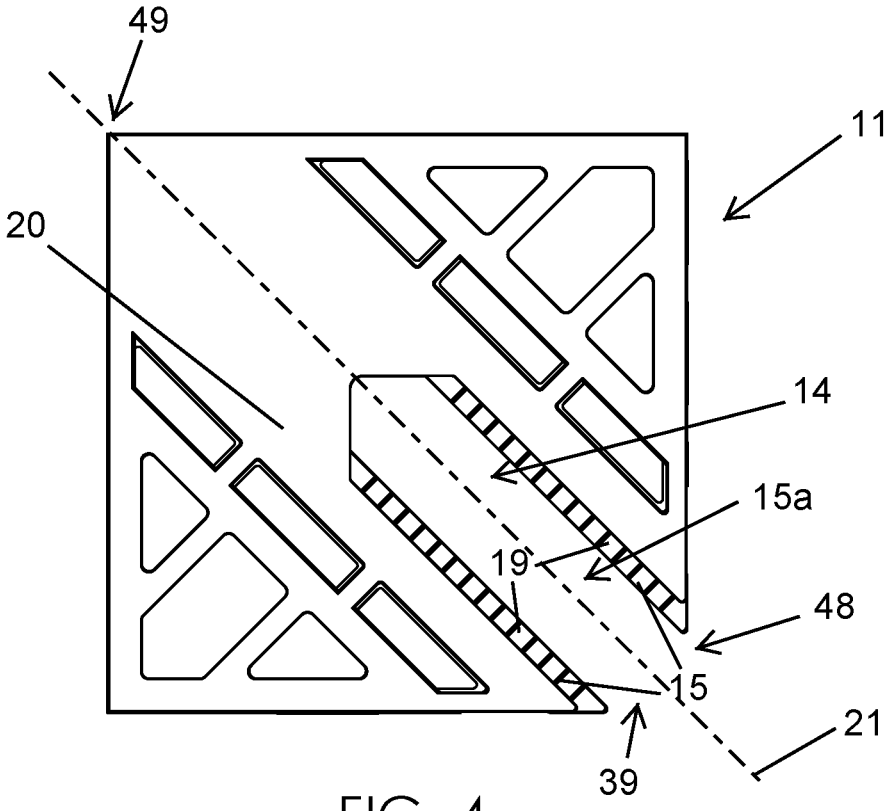
FIG. 4 is a bottom plan view of the base member shown in FIG. 1.
Figure 5:
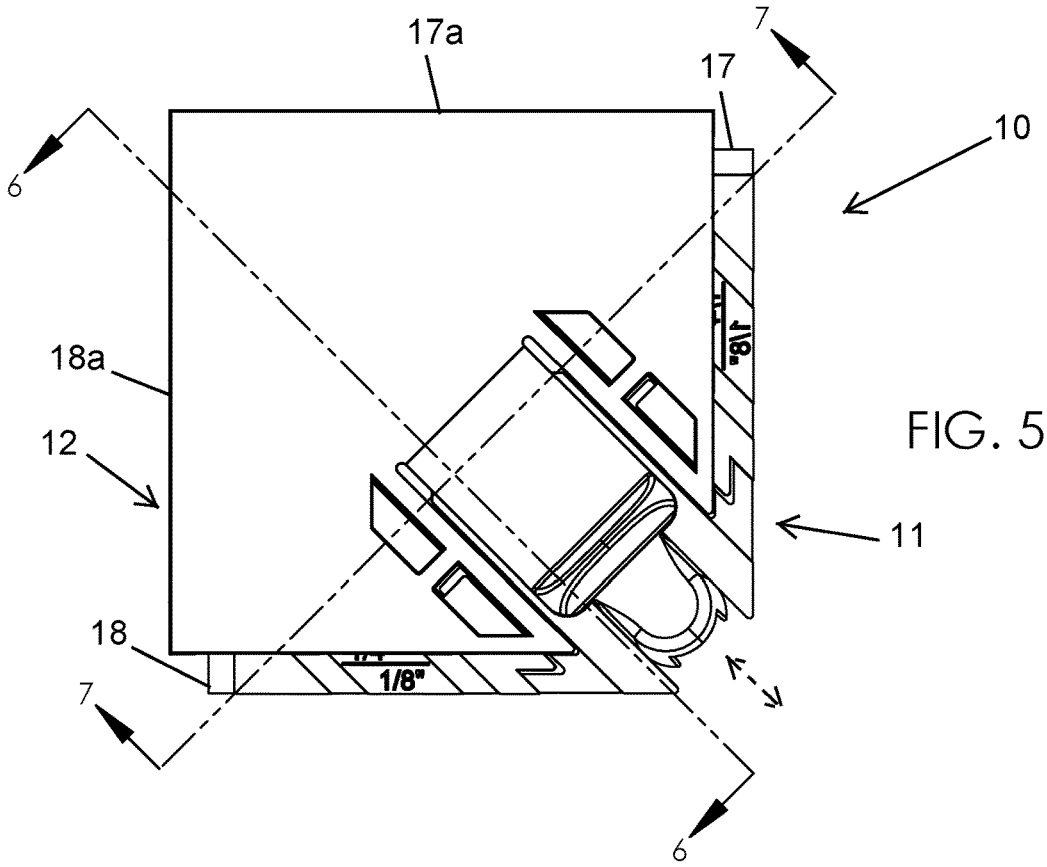
FIG. 5 is a top plan view of the scribe wherein the sliding member is partially retracted relative to the base member.
Figure 6:
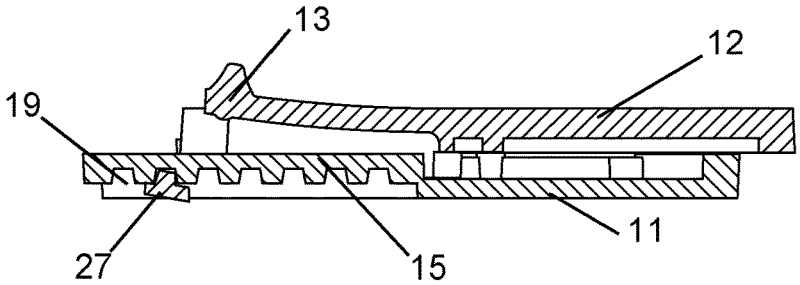
FIG. 6 is an enlarged cross-sectional view taken along line 6-6 in FIG. 5.
Figure 7:
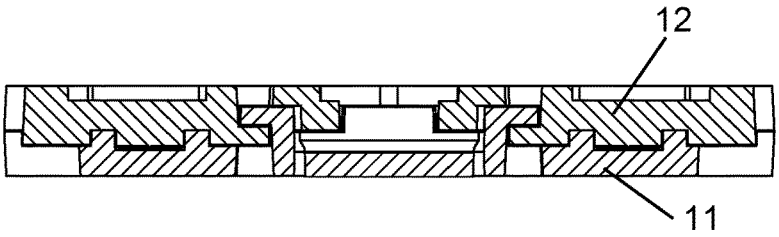
FIG. 7 is an enlarged cross-sectional view taken along line 7-7 in FIG. 5.
Figure 8:
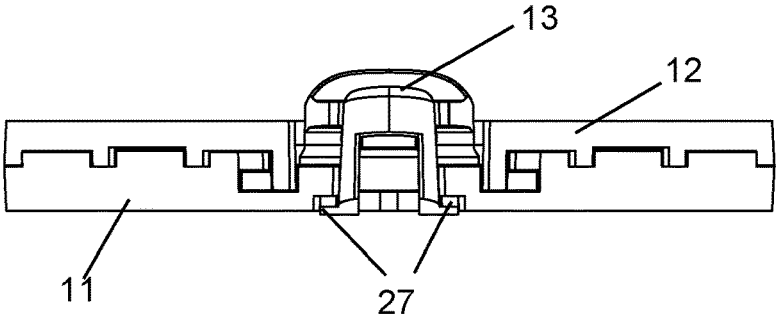
FIG. 8 is a front elevational view of the scribe shown in FIG. 1.
Figure 9:
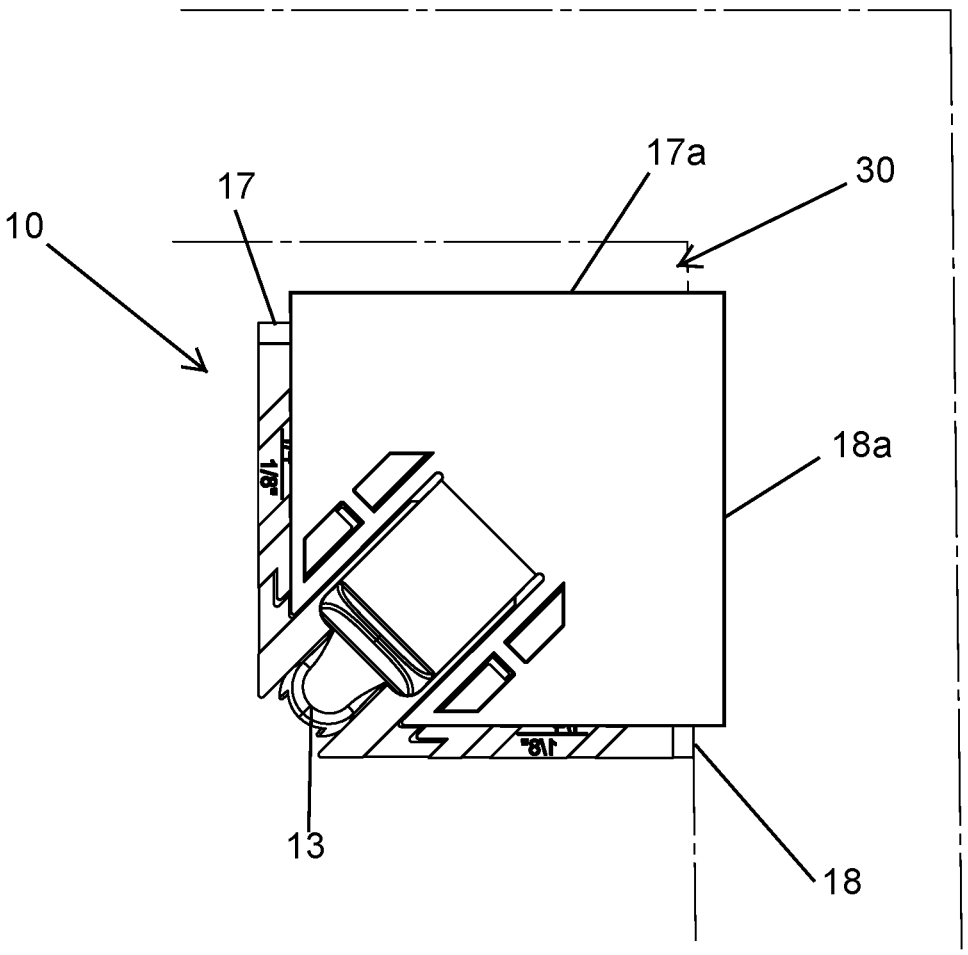
FIG. 9 is a top plan environmental view of the scribe offset from a corner of a door or window frame.
Figure 10:
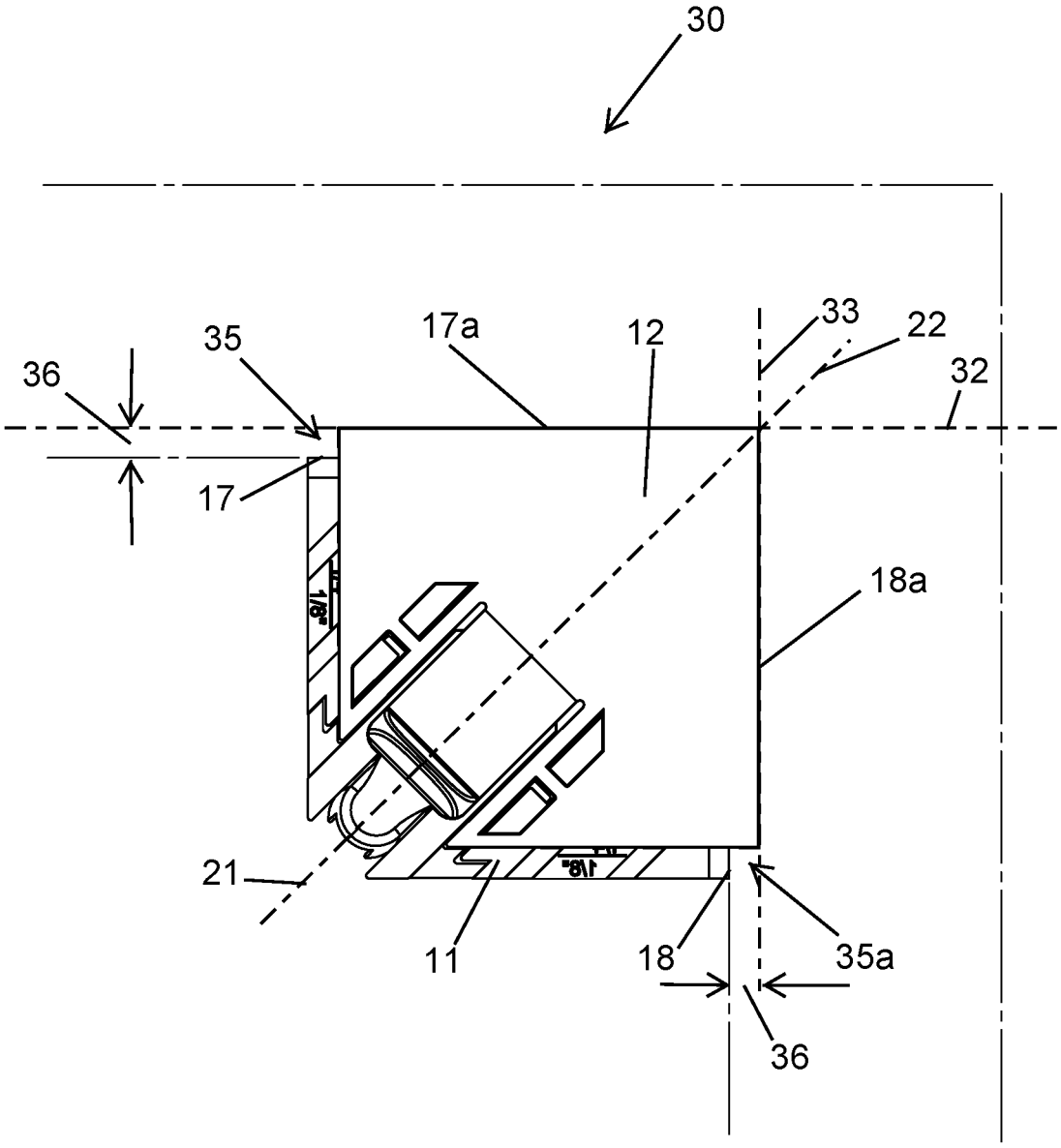
FIG. 10 is a top plan environmental view showing the base member of scribe abutted directly against the corner of the door or window frame shown in FIG. 9.

A non-limiting exemplary embodiment(s) of the present disclosure is referred to generally in FIGS. 1-10 and is/are intended to provide an adjustable carpentry reveal tool (scribe) 10 for simultaneously marking reveals along two orthogonal axes (e.g., x-axis 32, y-axis 33) at a trim corner of a door or window opening 30, without having to affix (e.g., via a nail or screw) the tool to the trim corner. It should be understood that the exemplary embodiment(s) may be used to mark corner reveals in a variety of openings, and should not be limited to only door and window openings described herein.

Referring to FIGS. 1-10 in general, an adjustable carpentry reveal tool 10 (scribe) including a base member 11, and a sliding member 12 slidably engaged to the base member 11 wherein the sliding member 12 is configured to be selectively displaced along predetermined linear increments 25 (e.g., ⅛ to ¾ inches) relative to the base member 11 without becoming detached from the base member 11. Advantageously, the sliding member 12 is configured to simultaneously mark a pair of adjustable reveals 35, 35*a* along the x-axis 32 and the y-axis 33 of the trim corner of the frame opening 30 without having to fasten (e.g., via a nail or screw) the base member 11 to the trim corner of the frame opening 30. Notably, in this manner, the adjustable reveals 35, 35*a* are simultaneously defined between an outermost periphery of the base member 11 and an outermost periphery of the sliding member 12.

In a non-limiting exemplary embodiment, the sliding member 12 includes a pair of contiguous rectilinear edges 17*a*, 18*a*, and the base member 11 includes a corresponding pair of contiguous rectilinear edges 17, 18. Advantageously, the contiguous rectilinear edges 17*a*, 18*a* of the sliding member 12 are linearly and equidistantly spaced from the contiguous rectilinear edges 17, 18 of the base member 11 when the sliding member 12 is linearly displaced relative to the base member 11. Notably, in this manner, the adjustable reveals 35, 35*a* are defined by a lateral distance 36 between the contiguous rectilinear edges 17*a*, 18*a* of the sliding member 12 and the contiguous rectilinear edges 17, 18 of the base member 11.

In a non-limiting exemplary embodiment, the contiguous rectilinear edges 17, 18 of the base member 11 are configured to be slidably and directly abutted against the trim corner of the frame opening 30 such that the contiguous rectilinear edges 17*a*, 18*a* of the sliding member 12 extend beyond the trim corner of the frame opening 30, thereby defining the reveals 35, 35*a*.

In a non-limiting exemplary embodiment, the base member 11 has a substantially square shape including a first open front corner 48 and a first closed rear corner 49 opposed therefrom. The base member 11 further includes a first longitudinal axis 21 centrally registered from the first open front corner 48 to the first closed rear corner 49. The sliding member 12 has a substantially square shape including a second open front corner 48*a* and a second closed rear corner 49*a* opposed therefrom, and a second longitudinal axis 22 centrally registered from the second open front corner 48*a* to the second closed rear corner 49*a*.

In a non-limiting exemplary embodiment, the sliding member 12 includes a ratchet 13 configured to be resiliently articulated relative to the base member 11. Notably, the base member 11 includes a bottom side 20 including a slot 14 having a slotted track 15*a* provided with a plurality of serrated sides 15 configured to selectively receive the ratchet 13 along a predetermined linear path 38. Such serrated sides 15 includes a plurality of notches 19. Notably, each of the first longitudinal axis 21 and the second longitudinal axis 22 are oriented parallel to the predetermined linear path 38.

In a non-limiting exemplary embodiment, the serrated notches 19 are equidistantly spaced apart at opposite sides of the first centrally registered longitudinal axis 21. Advantageously, the base member 11 further includes a top side 24 having a plurality of rectilinear grooves 23 disposed therealong. Such grooves 23 are extended parallel to the first centrally registered longitudinal axis 21 and the longitudinal distance between linear increments 25 (e.g., ⅛ to ¾ inches) of the sliding member 12. Surface indicia 25 including a plurality of predefined measurements is printed on the top side 24 of the base member 11 thereby identifying the measurements of the reveals 35, 35*a*. Advantageously, the sliding member 12 includes a plurality of rectilinear tongues 26 oppositely spaced apart and registered parallel to each other, such that the tongues 26 are slidably reciprocated within the grooves 23 when the sliding member 12 is reciprocated relative to the base member 11.

In a non-limiting exemplary embodiment, the ratchet 13 is disposed at the second open front corner 48*a* and includes a pair of oppositely facing fingers 27 extended outwardly and way from the second centrally registered longitudinal axis 22. Advantageously, such fingers 27 are selectively interlocked with the serrated sides 15 at the bottom side 20 of the base member 11.

In a non-limiting exemplary embodiment, the ratchet 13 is configured to be depressed downwardly towards the base member 11 such that the fingers 27 are displaced out from an initial pair of the notches 19 and the sliding member 12 is linearly displaced a desired distance along the grooves 23. Advantageously, the sliding member 12 is configured to be prohibited from being linearly displaced relative to the base member 11 when the fingers 27 are interlocked with a desired pair of the notches 19.

In a non-limiting exemplary embodiment, each of the first longitudinal axis 21 and the second longitudinal axis 22 are offset 45 degrees relative to each of the x-axis 32 and the y-axis 33. In this manner, each of the first longitudinal axis 21 and the second longitudinal axis 22 are offset 45 degrees relative to the longitudinal distance between the adjustable reveals 35, 35*a*.

The present disclosure further includes a method of utilizing a carpentry reveal tool 10 (scribe) for simultaneously marking two reveals 35, 35*a* along an x-axis 32 and a y-axis 33 at a trim corner of a frame opening 30. Such a method includes the steps of: providing a base member 11; providing and slidably engaging a sliding member 12 to the base member 11; positioning the base member 11 against the trim corner of the frame opening 30; selectively displacing the sliding member 12 along predetermined linear increments 25 (e.g., ⅛ to ¾ inches) relative to the base member 11 without detaching the sliding member 12 from the base member 11; and the sliding member 12 simultaneously marking (identifying) a pair of adjustable reveals 35, 35*a* along the x-axis 32 and the y-axis 33 of the trim corner of the frame opening 30 without having to fasten (e.g., via a nail or screw) the base member 11 to the trim corner of the frame opening 30. Advantageously, the adjustable reveals 35, 35*a* are simultaneously defined between an outermost periphery of the base member 11 and an outermost periphery of the sliding member 12.

Referring to FIGS. 1-10 in general, in a non-limiting exemplary embodiment(s), the adjustable carpentry reveal tool 10 provides rapid markings for placing trim molding onto frame openings 30 such as doors and windows. The carpentry reveal includes a two-part mechanism: a base member 11 and a sliding member 12 adjustably engaged to the base member 11. The sliding member 12 includes a thumb press ratchet 13 tab (lock) that has a starting ⅛th inch measurement of increments up to ¾th of an inch. The base member 11 has a slot 14 with serrated sides 15 for selectively receiving the ratchet 13 along a predetermined linear path. The reveal is able to slide at a 45-degree angle, relative to linear edges 17, 18 of the base member 11 and sliding member 12, along a slotted track (at serrated sides 15) to permit the two parts to move apart or closer together. Advantageously, a user does not need to nail down the material he/she wants to scribe for the reveal. When marking a corner 30, the user does not need to move the tool 10; both sides of the corner 30 can be marked at the same time. This benefit provides an unpredictable and unexpected improvement over similar devices that require you have to nail down the material you want to scribe your mark for the reveal.

In a non-limiting exemplary embodiment, the base member 11 includes a plurality of rectilinear edges 17, 18 configured to form a general square shape. One corner 48 of the base member 11 is open wherein adjoining edges thereof are spaced apart and do not abut each other. A gap 39 is located at the open corner 48 and extends inwardly towards a center of the base member 11. The gap 39 has oppositely seated sides 15 provided with a plurality of serrated notches 19 respectively located at a bottom side 20 of the base member 11. Such notches 19 are equidistantly spaced apart from a centrally registered longitudinal axis 21 of the base member 11. In addition, the base member 11 includes a plurality of rectilinear grooves 23 disposed along a top side 24 thereof. Such grooves 23 preferably extend parallel to the centrally registered longitudinal axis 21 and are oriented parallel thereto. Surface indicia 25 include a plurality of predefined measurements printed on the top side 24 of the base member 11. Such measurements identify the reveal distance, desired during trim work.

In a non-limiting exemplary embodiment, the sliding member 12 includes a plurality of rectilinear tongues 26 (guide rails) spaced apart and registered parallel to each other. Such tongues 26 are suitably sized and shaped to fit within and slide along the grooves 23 when the sliding member 12 is interconnected to the base member 11. A pivotal thumb-actuated ratchet 13 tab is disposed at a corner of the sliding member 12 above the gap 39 of the base member 11. Such a tab 13 has a pair of oppositely facing fingers 27 extending outwardly and way from a centrally registered longitudinal axis 22 of the sliding member 12. Such fingers 27 are suitably sized and shaped to be selectively interlocked with the notches 19 at the bottom side 20 of the base member 11. When the tab (ratchet 13) is depressed downwardly towards the base member 11, the fingers 27 are displaced out from an initial pair of corresponding notches 19. Then, after the sliding member 12 is linearly displaced a desired distance along the grooves 23, the tab (ratchet 13) is released thereby causing the fingers 27 to fit into another pair of notches 19. When the fingers 27 are seated into a desired pair of notches 19, the sliding member 12 is prohibited from being displaced relative to the base member 11.

Notably, as the sliding member 12 is offset from an equilibrium and rested position, a pair of rectilinear edges 17*a*, 18*a* thereof is spaced from a corresponding pair of rectilinear edges 17, 18 of the base member 11. The distance between the sliding member 12 edges 17*a*, 18*a* and base member 11 edges 17, 18 creates the reveal. In particular, the base member 11 edges 17, 18 are abutted against a corner of the frame opening 30 such that the sliding member 12 edges 17*a*, 18*a* extend beyond the frame opening 30 at a desired distance identified by the surface indicia 25 on the base member 11. Both the base member 11 edges 17, 18 and the sliding member 12 edges 17*a*, 18*a* are orthogonally oriented, respectively, for allowing a user to simultaneously mark the reveal along an x-axis 32 and a y-axis 33.

The present disclosure is a simple easy she can use tool 10 to mark your reveal as needed at the measurement you want to mark and scribe it. You can mark straight edges and corners. When marking the corners, you don't need to move the tool 10. You can simultaneously mark both sides of the corner at one time. It is a fast and easy tool 10 for use at a fast pace job.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An adjustable carpentry reveal tool for simultaneously marking two reveals along an x-axis and a y-axis at a trim corner of a frame opening, said adjustable carpentry reveal tool comprising:

a base member; and a sliding member engaged to said base member;

wherein said sliding member is configured to be selectively displaced along increments relative to said base member;

wherein said sliding member is configured to simultaneously mark a pair of adjustable reveals along the x-axis and the y-axis of the trim corner of the frame opening without having to fasten said base member to the trim corner of the frame opening;

wherein said sliding member is flexible and resiliently displaced relative to said base member, said sliding member being configured to selectively engage and disengage said base member when resiliently displaced to a non-planar position.

2. The adjustable carpentry reveal tool of claim 1, wherein said sliding member comprises: a pair of contiguous rectilinear edges, wherein said base member comprises a corresponding pair of contiguous rectilinear edges;

wherein said contiguous rectilinear edges of said sliding member are linearly and equidistantly spaced from said contiguous rectilinear edges of said base member when said sliding member is linearly displaced relative to said base member;

wherein said adjustable reveals are defined by a lateral distance between said contiguous rectilinear edges of said sliding member and said contiguous rectilinear edges of said base member.

3. The adjustable carpentry reveal tool of claim 2, wherein said contiguous rectilinear edges of said base member are configured to be slidably and directly abutted against the trim corner of the frame opening such that said contiguous rectilinear edges of said sliding member extend beyond the trim corner of the frame opening.

4. The adjustable carpentry reveal tool of claim 3, wherein said base member has a substantially square shape comprising: a first open front corner and a first closed rear corner opposed therefrom, and a first longitudinal axis centrally registered from said first open front corner to said first closed rear corner; and wherein said sliding member has a substantially square shape comprising: a second open front corner and a second closed rear corner opposed therefrom, and a second longitudinal axis centrally registered from said second open front corner to said second closed rear corner.

5. The adjustable carpentry reveal tool of claim 4, wherein said sliding member comprises: a ratchet configured to be resiliently articulated relative to said base member;

wherein said base member comprises: a bottom side including a slot having a slotted track provided with a plurality of serrated sides configured to selectively receive said ratchet along a predetermined linear path, said serrated sides including a plurality of notches;

wherein each of the first longitudinal axis and the second longitudinal axis are oriented parallel to the predetermined linear path.

6. The adjustable carpentry reveal tool of claim 5, wherein said serrated notches are equidistantly spaced apart at opposite sides of the first centrally registered longitudinal axis;

wherein said base member further includes:

a top side having a plurality of rectilinear grooves disposed therealong, said grooves being extended parallel to the first centrally registered longitudinal axis and said increments of said sliding member, and surface indicia including a plurality of predefined measurements printed on said top side of said base member thereby identifying said reveal;

wherein said sliding member comprises a plurality of rectilinear tongues oppositely spaced apart and registered parallel to each other, said tongues being slidably reciprocated within said grooves when said sliding member is reciprocated relative to said base member.

7. The adjustable carpentry reveal tool of claim 6, wherein said ratchet is disposed at said second open front corner and includes a pair of oppositely facing fingers extended outwardly and way from said second centrally registered longitudinal axis, said fingers being selectively interlocked with said serrated sides at said bottom side of said base member.

8. The adjustable carpentry reveal tool of claim 7, wherein said ratchet is configured to be depressed downwardly towards said base member such that said fingers are displaced out from an initial pair of said notches and said sliding member is linearly displaced a desired distance along said grooves;

wherein said sliding member is configured to be prohibited from being displaced relative to said base member when said fingers are interlocked with a desired pair of said notches.

9. The adjustable carpentry reveal tool of claim 3, wherein each of the first longitudinal axis and the second longitudinal axis are offset 45 degrees relative to each of the x-axis and the y-axis;

wherein each of the first longitudinal axis and the second longitudinal axis are offset 45 degrees relative to said adjustable reveals.

10. An adjustable carpentry reveal tool for simultaneously marking two reveals along an x-axis and a y-axis at a trim corner of a frame opening, said adjustable carpentry reveal tool comprising:

a base member; and a sliding member engaged to said base member;

wherein said sliding member is configured to be selectively displaced along predetermined linear increments relative to said base member;

wherein said sliding member is configured to simultaneously mark a pair of adjustable reveals along the x-axis and the y-axis of the trim corner of the frame opening without having to fasten said base member to the trim corner of the frame opening;

wherein said adjustable reveals are defined between a periphery of said base member and a periphery of said sliding member;

wherein said sliding member is flexible and resiliently displaced along an arcuate path non-planar to said x-axis and said y-axis.

11. The adjustable carpentry reveal tool of claim 10, wherein said sliding member comprises: a pair of contiguous rectilinear edges, wherein said base member comprises a corresponding pair of contiguous rectilinear edges;

wherein said contiguous rectilinear edges of said sliding member are linearly and equidistantly spaced from said contiguous rectilinear edges of said base member when said sliding member is linearly displaced relative to said base member;

wherein said adjustable reveals are defined by a lateral distance between said contiguous rectilinear edges of said sliding member and said contiguous rectilinear edges of said base member.

12. The adjustable carpentry reveal tool of claim 11, wherein said contiguous rectilinear edges of said base member are configured to be slidably and directly abutted against the trim corner of the frame opening such that said contiguous rectilinear edges of said sliding member extend beyond the trim corner of the frame opening.

13. The adjustable carpentry reveal tool of claim 12, wherein said base member has a substantially square shape comprising: a first open front corner and a first closed rear corner opposed therefrom, and a first longitudinal axis centrally registered from said first open front corner to said first closed rear corner; and wherein said sliding member has a substantially square shape comprising: a second open front corner and a second closed rear corner opposed therefrom, and a second longitudinal axis centrally registered from said second open front corner to said second closed rear corner.

14. The adjustable carpentry reveal tool of claim 13, wherein said sliding member comprises: a ratchet configured to be resiliently articulated relative to said base member;

wherein said base member comprises: a bottom side including a slot having a slotted track provided with a plurality of serrated sides configured to selectively receive said ratchet along a predetermined linear path, said serrated sides including a plurality of notches;

wherein each of the first longitudinal axis and the second longitudinal axis are oriented parallel to the predetermined linear path.

15. The adjustable carpentry reveal tool of claim 14, wherein said serrated notches are equidistantly spaced apart at opposite sides of the first centrally registered longitudinal axis;

wherein said base member further includes:

a top side having a plurality of rectilinear grooves disposed therealong, said grooves being extended parallel to the first centrally registered longitudinal axis and said linear increments of said sliding member, and surface indicia including a plurality of predefined measurements printed on said top side of said base member thereby identifying said reveal;

wherein said sliding member comprises a plurality of rectilinear tongues oppositely spaced apart and registered parallel to each other, said tongues being slidably reciprocated within said grooves when said sliding member is reciprocated relative to said base member.

16. The adjustable carpentry reveal tool of claim 15, wherein said ratchet is disposed at said second open front corner and includes a pair of oppositely facing fingers extended outwardly and way from said second centrally registered longitudinal axis, said fingers being selectively interlocked with said serrated sides at said bottom side of said base member.

17. The adjustable carpentry reveal tool of claim 16, wherein said ratchet is configured to be depressed downwardly towards said base member such that said fingers are displaced out from an initial pair of said notches and said sliding member is linearly displaced a desired distance along said grooves;

wherein said sliding member is configured to be prohibited from being displaced relative to said base member when said fingers are interlocked with a desired pair of said notches.

18. The adjustable carpentry reveal tool of claim 12, wherein each of the first longitudinal axis and the second longitudinal axis are offset 45 degrees relative to each of the x-axis and the y-axis;

wherein each of the first longitudinal axis and the second longitudinal axis are offset 45 degrees relative to said adjustable reveals.

19. A method of utilizing a carpentry reveal tool for simultaneously marking two reveals along an x-axis and a y-axis at a trim corner of a frame opening, said method comprising the steps of:

providing a base member;

providing and engaging a sliding member to said base member;

positioning said base member against the trim corner of the frame opening;

selectively displacing said sliding member along predetermined linear increments relative to said base member; and said sliding member simultaneously marking a pair of adjustable reveals along the x-axis and the y-axis of the trim corner of the frame opening without having to fasten said base member to the trim corner of the frame opening;

wherein said adjustable reveals are defined between a periphery of said base member and a periphery of said sliding member;

wherein said sliding member is flexible and resiliently displaced relative to said base member, said sliding member being configured to selectively engage and disengage said base member when resiliently displaced to a non-planar position;

wherein said sliding member is flexible and resiliently displaced along an arcuate path non-planar to said x-axis and said y-axis.

* * * * *